US008628379B1

(12) United States Patent
Galindo

(10) Patent No.: US 8,628,379 B1
(45) Date of Patent: Jan. 14, 2014

(54) DUST COLLECTION BAG FOR MANUAL SANDER

(76) Inventor: Luis A. Galindo, Los Angeles, CA (US)

( * ) Notice: Subject to any disclaimer, the term of this patent is extended or adjusted under 35 U.S.C. 154(b) by 245 days.

(21) Appl. No.: 13/240,023

(22) Filed: Sep. 22, 2011

(51) Int. Cl.
*B24B 27/08* (2006.01)

(52) U.S. Cl.
USPC ..... 451/344; 451/354; 451/453; 451/456

(58) Field of Classification Search
USPC ..... 451/456, 453, 451, 354, 351, 350, 451/523–525
See application file for complete search history.

(56) References Cited

U.S. PATENT DOCUMENTS

| | | | | | |
|---|---|---|---|---|---|
| 2,347,334 | A * | 4/1944 | Schmieg | 454/63 |
| 2,803,098 | A * | 8/1957 | Downing et al. | 451/456 |
| 3,938,283 | A * | 2/1976 | Keith, Jr. | 451/344 |
| 4,697,389 | A * | 10/1987 | Romine | 451/354 |
| 4,771,579 | A * | 9/1988 | Giese | 451/88 |
| 4,937,984 | A * | 7/1990 | Taranto | 451/524 |
| 5,193,313 | A * | 3/1993 | Sanchez et al. | 451/344 |
| 5,540,616 | A * | 7/1996 | Thayer | 451/354 |
| 5,624,305 | A * | 4/1997 | Brown | 451/354 |
| 6,860,799 | B2 * | 3/2005 | Loveless | 451/354 |
| 6,988,940 | B1 * | 1/2006 | Taylor | 451/354 |
| 7,104,877 | B1 | 9/2006 | Terry | |
| 7,216,572 | B2 * | 5/2007 | Keenan | 83/100 |
| 7,249,996 | B1 * | 7/2007 | Volyar | 451/354 |
| 8,137,156 | B1 * | 3/2012 | Gasman | 451/28 |

* cited by examiner

*Primary Examiner* — George Nguyen
(74) *Attorney, Agent, or Firm* — DLA Piper LLP (US)

(57) ABSTRACT

A dust collection assembly for a manual sander, having a bag with an open upper end and a lower end terminating in an aperture, and a rigid frame supporting the open upper end of the bag. The rigid frame includes a periphery to which the open upper end of the bag is attached, and a pair of opposing engagement portions extending from the periphery towards a center of the open upper end of the bag. The manual sander includes a sanding element and a pole rotatably mounted thereto. The pole extends through the bag's aperture, and each of the engagement portions is removably connected to mounting bolts on the sanding element such that the sanding element is rigidly held at the open upper end of the bag so that the bag collects dust and debris created by the sanding element during use.

20 Claims, 3 Drawing Sheets

DUST COLLECTION BAG FOR MANUAL SANDER

FIELD OF THE INVENTION

The present invention relates to drywall sanding, and more particular to a dust collection bag for collecting dust and debris created by the use of manual drywall sanders.

BACKGROUND OF THE INVENTION

Manual drywall sanders typically include a sanding element (e.g. sandpaper mounted to a support plate), and a pole mounted to the sanding element. The user can sand high walls and ceilings without using a ladder by using the pole to manipulate the sanding element over the surface to be sanded (i.e. the working surface). However, since the working surface of the wall or ceiling is above the user's head, dust and debris from the sanding process falls down onto the user, creating health issues for the user's eyes and lungs.

One proposed solution is disclosed in U.S. Pat. No. 7,104,877, which is incorporated herein by reference for all purposes. This patent discloses a dust collection bag that attaches over the sanding element to collect dust and debris. The dust collection bag is attached to the sanding element via springs. When not in use, the dust bag extends beyond the sanding element (i.e. the sanding element is retracted inside the open end of the bag). When the user presses the device against the working surface, the open end of the bag first engages the working surface, after which the bag is pushed backward by the working surface (against the force of the springs) until the sanding element becomes flush with the open end of the bag (so that both the bag and the sanding element engage with the working surface). When the device is withdrawn from the working surface, the sanding element recedes back into the open end of the bag.

There are several drawbacks to the device disclosed in the U.S. Pat. No. 7,104,877. First, if the user wants to pull back the device to see the working surface, they have to pull back the extra amount it takes for the sanding element to recede into the bag (so that the bag can be withdrawn from the working surface). Additionally, having the sanding element retract in and out of the bag, and having the bag collapse and expand each time the working surface is engaged, tends to blow the collected dust and debris out of the bag. For some surfaces, the spring loaded force of the bag on the working surface can make it difficult to effectively sand that surface (i.e. the friction of the bag on the working surface makes it difficult to operate the sanding element effectively). In practice, the device is not convenient or efficient to use.

There is a need for a dust collection mechanism for a manual sander that efficiently collects dust and debris, without unduly blocking the field of view of the working surface when the device is withdrawn therefrom.

BRIEF SUMMARY OF THE INVENTION

The aforementioned problems and needs are addressed by a dust collection assembly that includes a bag having an open upper end and a lower end terminating in an aperture and a rigid frame supporting the open upper end of the bag. The rigid frame includes a periphery to which the open upper end of the bag is attached, and a pair of opposing engagement portions extending from the periphery towards a center of the open upper end of the bag.

A manual sander assembly includes a sanding element with an upper sanding surface and a lower surface with mounting bolts extending therefrom, a pole rotatably connected to the sanding element lower surface, a bag having an open upper end and a lower end terminating in an aperture where the pole extends through the aperture, and a rigid frame supporting the open upper end of the bag. The rigid frame includes a periphery to which the open upper end of the bag is attached, and a pair of opposing engagement portions extending from the periphery towards a center of the open upper end of the bag. Each of the engagement portions is removably connected to one of the mounting bolts such that the sanding element is rigidly held at the open upper end of the bag.

Other objects and features of the present invention will become apparent by a review of the specification, claims and appended figures.

DETAILED DESCRIPTION OF THE INVENTION

Figure 1:
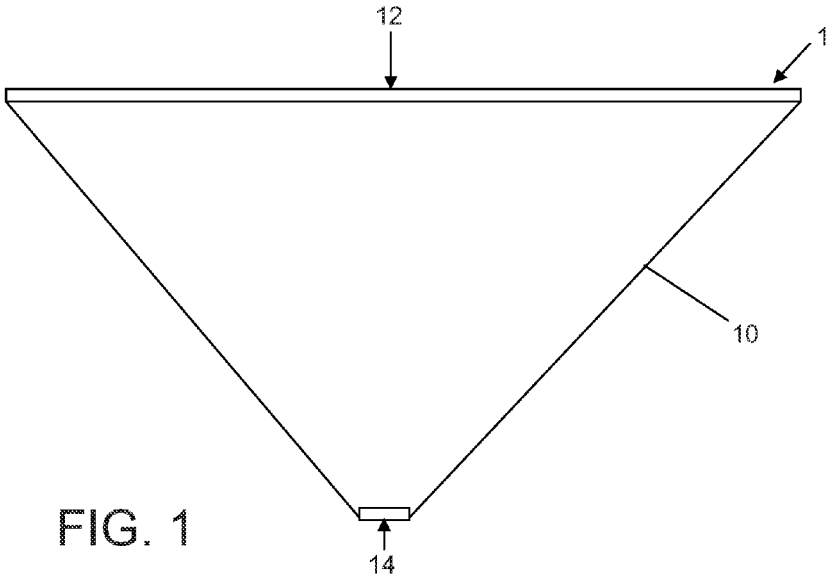
FIG. 1 is a side view of the dust collection bag assembly of the present invention.
Figure 2:
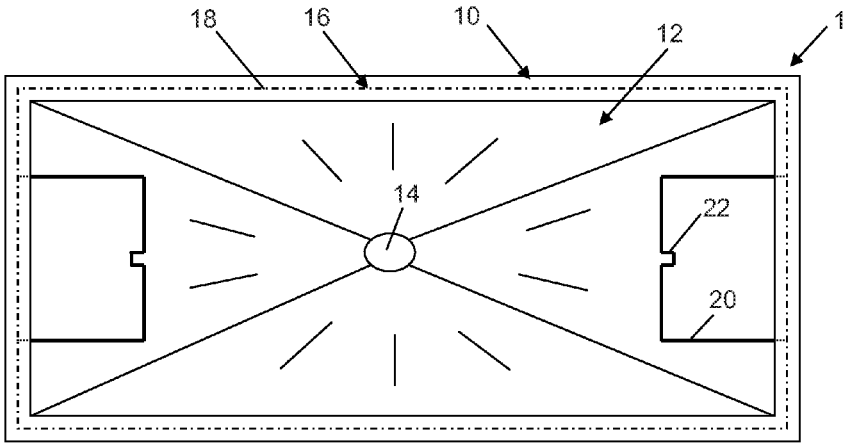
FIG. 2 is a top view of the dust collection bag assembly of the present invention.

The present invention is a dust/debris collection bag assembly 1 illustrated in FIGS. 1-4. The bag assembly 1 includes a conical shaped bag 10 made of a flexible material such as cloth, canvas or plastic. Bag 10 has an open upper end 12, and a lower end terminating in an aperture 14. Preferably aperture 14 is formed with an elastic material (e.g. elastic material 15 is disposed around aperture 14) such that aperture 14 can expand and contract. The open upper end 12 of bag 10 is supported by a rigid frame 16. Frame 16 includes an outer periphery 18 that engages with and supports the open end 12 of bag 10, and a pair of sanding element engagement portions 20 extending toward the center of the open end 12. Preferably, sanding element engagement portions 20 are U-shaped protrusions extending from the outer periphery 18 toward the center of open end 12, and each include a notch 22 extending away from the center of open end 12.

Figure 3:
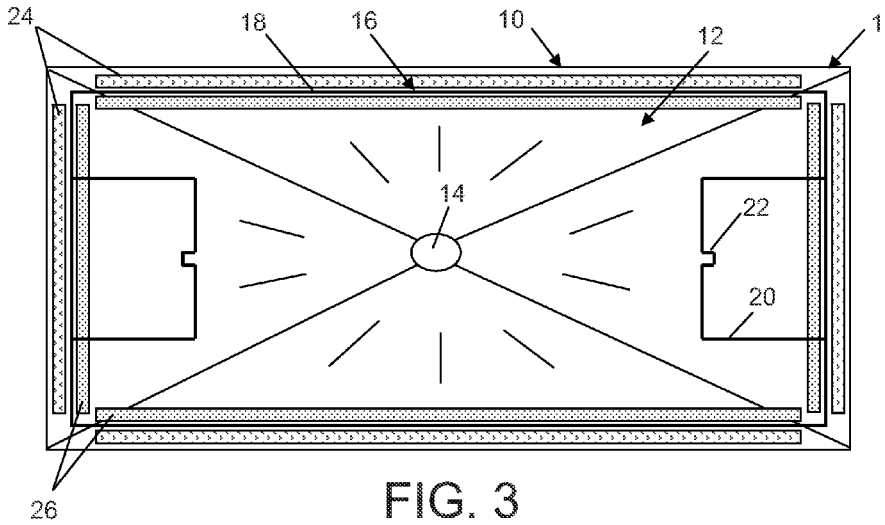
FIG. 3 is a top view of the dust collection bag assembly of the present invention in which the top edge of the bag is unfolded from the outer periphery of the frame.
Figure 4:
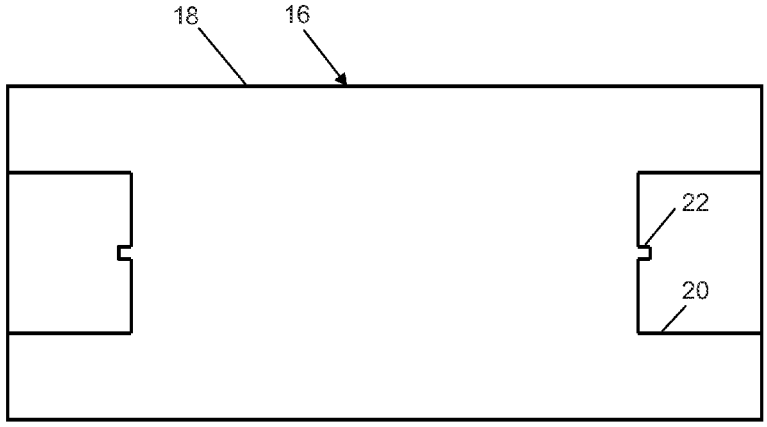
FIG. 4 is a top view of the frame.

The edges of bag 10 that form the open end 12 preferably fold over and engage with the outer periphery 18. This engagement can be removably secured by the use of hook and loop attachment strips 24/26, as best shown in FIG. 3 (where the edges of bag 10 are shown in their unfolded position).

Figure 5:
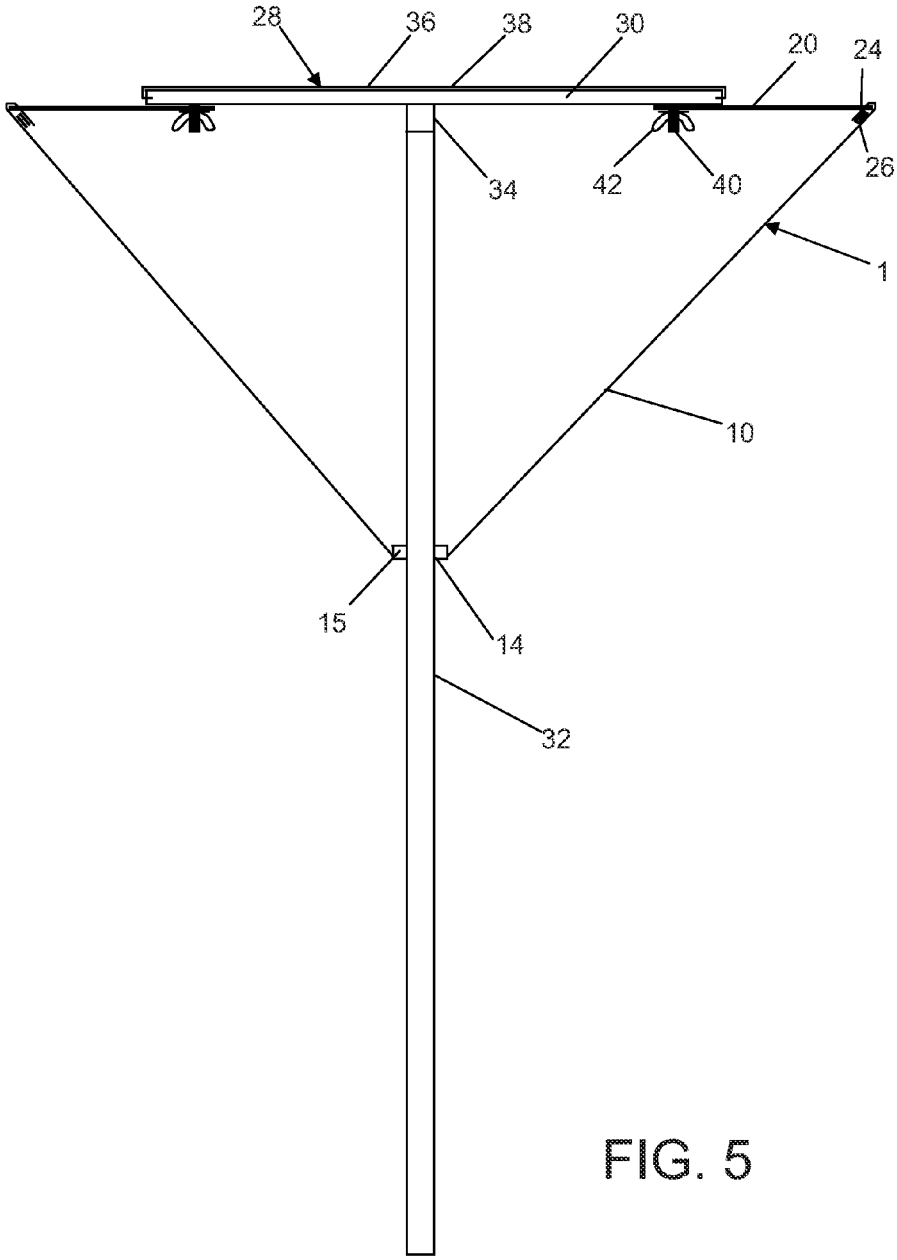
FIG. 5 is a side cross sectional view of the dust collection bag assembly attached to a manual sander.

The engagement of the bag assembly 1 to a manual sander 28 is shown in FIG. 5. The manual sander 28 includes a sanding element 30 and a pole 32 preferably rotatably mounted to the sanding element 30 via a swivel joint 34. The sanding element 30 includes an abrasive sanding surface 36. Sanding element 30 can be unitary (in which case the abrasive surface is formed as the upper surface of the sanding element 30), or can include well known means for removably mounting sandpaper 38 over the upper surface 36 of the sanding element 30 (e.g. slots on the side surface secure the edges of the sandpaper 38) as shown in FIG. 5, where the top surface 36 of the sanding element is a support surface for sandpaper 38. The sanding element 28 also includes mounting bolts 40 extending from its lower surface.

The bag assembly 1 is mounted to the manual sander 28 by sliding pole 32 through aperture 14 until the open end 12 of bag 10 is even with the sanding element 30. The bolts 40 are inserted into notches 22 of frame 16, and secured thereto using any appropriate securing means (e.g. wing nuts 42). Once mounted, the open end 12 of bag 10 is rigidly held even with sanding element 30.

During use, the open end 12 of bag 10 is rigidly held approximately even with the sanding element 30, so that any dust or debris generated by sanding the working surface will be collected by bag 10. A snug fit (e.g. by the use of elastic material) of aperture 14 around pole 32 will prevent the dust/debris from leaking out the bottom of bag 10. Preferably, frame 16 (or at least the engagement portions 20 thereof) are formed of a rigid but malleable material (e.g. metal). Therefore, the precise alignment of the open end 12 of bag 10 relative to the sanding element 30 can be adjusted by bending the engagement portions 20 of frame 16. Thus, the user can adjust the assembly such that, during use, the open end 12 of bag 10 slides along the working surface along with the sanding element 30, or the open end 12 of bag 10 is spaced from the working surface by a predetermined gap of the user's choice, depending upon the conditions and type of working surface involved. Once set, this alignment can stay fixed during use. Also during use, the user can withdraw the sanding element from the working surface without having the bag obscure the working surface. Also, by including a notch 22 in the engagement portions 20, the engagement portions 20 can be secured to and removed from bolts 40 without having to completely remove wing nuts 42.

It is to be understood that the present invention is not limited to the embodiment(s) described above and illustrated herein, but encompasses any and all variations falling within the scope of the appended claims. For example, references to the present invention herein are not intended to limit the scope of any claim or claim term, but instead merely make reference to one or more features that may be covered by one or more of the claims.

What is claimed is:

1. A dust collection assembly, comprising:

a bag having an open upper end and a lower end terminating in an aperture;

a rigid frame supporting the open upper end of the bag, wherein the rigid frame includes:

a periphery to which the open upper end of the bag is attached, and a pair of rigid opposing engagement portions extending from the periphery towards a center of the open upper end of the bag.

2. The dust collection assembly of claim 1, wherein the bag is conical in shape.

3. The dust collection assembly of claim 1, wherein the periphery is rectangular in shape.

4. The dust collection assembly of claim 1, wherein each of the engagement portions are U-shaped.

5. The dust collection assembly of claim 4, wherein each of the engagement portions include a notch extending away from the center of the open upper end of the bag.

6. The dust collection assembly of claim 1, wherein the rigid frame is releasably attached to the open upper end of the bag.

7. The dust collection assembly of claim 6, wherein the releasable attachment comprises strips of hook and loop connectors attached to the bag.

8. The dust collection assembly of claim 1, wherein the rigid frame is made of a malleable metal material.

9. The dust collection assembly of claim 1, further comprising:

elastic material disposed around the aperture.

10. A manual sander assembly, comprising:

a sanding element with an upper sanding surface and a lower surface with mounting bolts extending therefrom;

a pole rotatably connected to the sanding element lower surface;

a bag having an open upper end and a lower end terminating in an aperture, wherein the pole extends through the aperture;

a rigid frame supporting the open upper end of the bag, wherein the rigid frame includes:

a periphery to which the open upper end of the bag is attached, and a pair of opposing engagement portions extending from the periphery towards a center of the open upper end of the bag;

wherein each of the engagement portions is removably connected to one of the mounting bolts such that the sanding element is rigidly held at the open upper end of the bag.

11. The manual sander of claim 10, further comprising:

a pair of wing nuts each of which securing one of the engagement portions to one of the mounting bolts.

12. The manual sander of claim 10, wherein the upper sanding surface includes sand paper removably attached to the sanding element.

13. The manual sander of claim 10, wherein the bag is conical in shape.

14. The manual sander of claim 10, wherein the periphery is rectangular in shape.

15. The manual sander of claim 10, wherein each of the engagement portions are U-shaped.

16. The manual sander of claim 15, wherein each of the engagement portions include a notch extending away from the center of the open upper end of the bag, and wherein the each of the mounting bolts extends through one of the notches.

17. The manual sander of claim 10, wherein the rigid frame is releasably attached to the open upper end of the bag.

18. The manual sander of claim 17, wherein the releasable attachment comprises strips of hook and loop connectors attached to the bag.

19. The manual sander of claim 10, wherein the rigid frame is made of a malleable metal material.

20. The manual sander of claim 10, further comprising:

elastic material disposed around the aperture.

* * * * *